US007295974B1

(12) United States Patent
Stachurski et al.

(10) Patent No.: US 7,295,974 B1
(45) Date of Patent: Nov. 13, 2007

(54) ENCODING IN SPEECH COMPRESSION

(75) Inventors: Jacek Stachurski, Dallas, TX (US); Alan V McCree, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 535 days.

(21) Appl. No.: 09/522,421

(22) Filed: Mar. 9, 2000

Related U.S. Application Data

(60) Provisional application No. 60/124,089, filed on Mar. 12, 1999.

(51) Int. Cl.
*G10L 19/00* (2006.01)

(52) U.S. Cl. ..... 704/230; 704/219; 704/220; 704/222

(58) Field of Classification Search ..... 704/220, 704/208, 201, 219, 222, 230, 214, 209, 205, 704/500, 223, 200.1; 375/240.15, 240.23, 375/240.27; 714/756, 822, 824
See application file for complete search history.

(56) References Cited

U.S. PATENT DOCUMENTS 5,794,180 A * 8/1998 McCree ..... 704/212
5,806,027 A * 9/1998 George et al. ..... 704/230
5,896,176 A * 4/1999 Das et al. ..... 375/240.15
5,966,689 A * 10/1999 McCree ..... 704/219
6,003,000 A * 12/1999 Ozzimo et al. ..... 704/205
6,122,608 A * 9/2000 McCree ..... 704/219
6,233,550 B1 * 5/2001 Gersho et al. ..... 704/208
6,377,916 B1 * 4/2002 Hardwick ..... 704/208
6,775,649 B1 * 8/2004 DeMartin ..... 704/201

FOREIGN PATENT DOCUMENTS

EP 0 814 458 A2 * 12/1997
WO WO 01/22403 A1 * 3/2001

OTHER PUBLICATIONS

Salami et al., ("A Toll Quality 8 Kb/s speech Codec for the Personal Communications System (PCS)", IEEE transactions on Vehicular Technology, vol. 43, Issue 3, part 1-2, Aug. 1994, pp. 808-816).*
Watkins et al., ("Improving 16 kb/s G.728 LD-CELP speech coder for frame erasure channels", ICASSP-95., 1995 International Conference on Acoustics, Speech and Signal Processing, vol. 1, May 9-12, 1995, pp. 241-244).*
Wang et al., ("Parameter interpolation to enhance the frame erasure robustness of CELP coders in packet networks", Proceedings. ICASSP'01), 2001 IEEE International Conference on Acoustics, Speech and Signal Processing, vol. 2, pp. 745-748).*

* cited by examiner

*Primary Examiner*—Vijay B. Chawan
(74) *Attorney, Agent, or Firm*—Wade J. Brady, III; Frederick J. Telecky, Jr.

(57) ABSTRACT

Linear predictive system with classification of LP residual Fourier coefficients into two or more overlapping classes, and each class has its own vector quantization codebook(s). The use of strong and weak predictors minimizes codebook size by only quantizing the difference between Fourier coefficients of a frame and the Fourier coefficients predicted from a prior frame. The choice of using either a strong or weak predictor adapts to the prior choice of predictor so that a strong predictor following a weak predictor is changed to a weak predictor to insure attenuation of error propagation as arise from frame erasures.

4 Claims, 3 Drawing Sheets

ENCODING IN SPEECH COMPRESSION

BACKGROUND OF THE INVENTION

The invention relates to electronic devices, and, more particularly, to speech coding, transmission, storage, and synthesis circuitry and methods.

The performance of digital speech systems using low bits rates has become increasingly important with current and foreseeable digital communications. One digital speech method, linear predictive coding (LPC), uses a parametric model to mimic human speech. In this approach only the parameters of the speech model are transmitted across the communication channel (or stored), and a synthesizer regenerates the speech with the same perceptual characteristics as the input speech waveform. Periodic updating of the model parameters requires fewer bits than direct representation of the speech signal, so a reasonable LPC vocoder can operate at bits rates as low as 2-3 Kbps (kilobits per second) whereas the public telephone system uses 64 Kbps (8 bit PCM codewords at 8,000 samples per second). See for example, McCree et al, A 2.4 Kbit/s MELP Coder Candidate for the New U.S. Federal Standard, Proc. IEEE Int.Conf.ASSP 200 (1996) and U.S. Pat. No. 5,699,477.

However, the speech output from such LPC vocoders is not acceptable in many applications because it does not always sound like natural human speech, especially in the presence of background noise. And there is a demand for a speech vocoder with at least telephone quality speech at a bit rate of about 4 Kbps. Various approaches to improve quality include enhancing the estimation of the parameters of a mixed excitation linear prediction (MELP) system and more efficient quantization of them. See Yeldener et al, A Mixed Sinusoidally Excited Linear Prediction coder at 4 kb/s and Below, Proc. IEEE Int. Conf. Acoust., Speech, Signal Processing (1998) and Shlomot et al, Combined Harmonic and Waveform Coding of Speech at Low Bit Rates, IEEE . . . 585 (1998).

SUMMARY OF THE INVENTION

The present invention provides a linear predictive coding method with the residual's Fourier coefficients classified into overlapping classes with each class having its own vector quantization codebook(s).

Additionally, both strongly predictive and weakly predictive codebooks may be used but with a weak predictor replacing a strong predictor which otherwise would have followed a weak predictor.

This has the advantages including maintenance of low bit rates but with increased performance and avoidance of error propagation by a series of strong predictors.

BRIEF DESCRIPTION OF THE DRAWINGS

The drawings are heuristic for clarity.

DESCRIPTION OF THE PREFERRED EMBODIMENTS

Overview

Figure 1A:
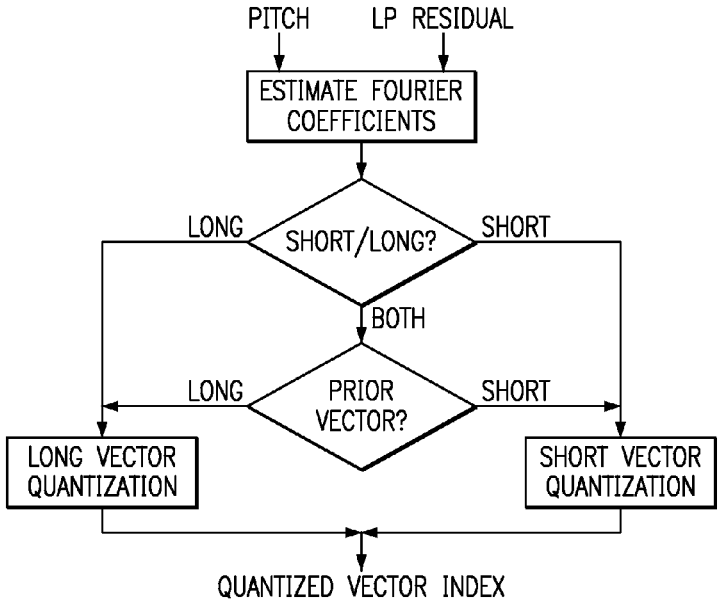
FIGS. 1*a*-1*b* are flow diagrams of a preferred embodiments.

First preferred embodiments classify the spectra of the linear prediction (LP) residual (in a MELP coder) into classes of spectra (vectors) and vector quantize each class separately. For example, one first preferred embodiment classifies the spectra into long vectors (many harmonics which correspond roughly to low pitch frequency as typical of male speech) and short vectors (few harmonics which correspond roughly to high pitch frequency as typical of female speech). These spectra are then vector quantized with separate codebooks to facilitate encoding of vectors with different numbers of components (harmonics). FIG. 1*a* shows the classification flow and includes an overlap of the classes.

Figure 1B:
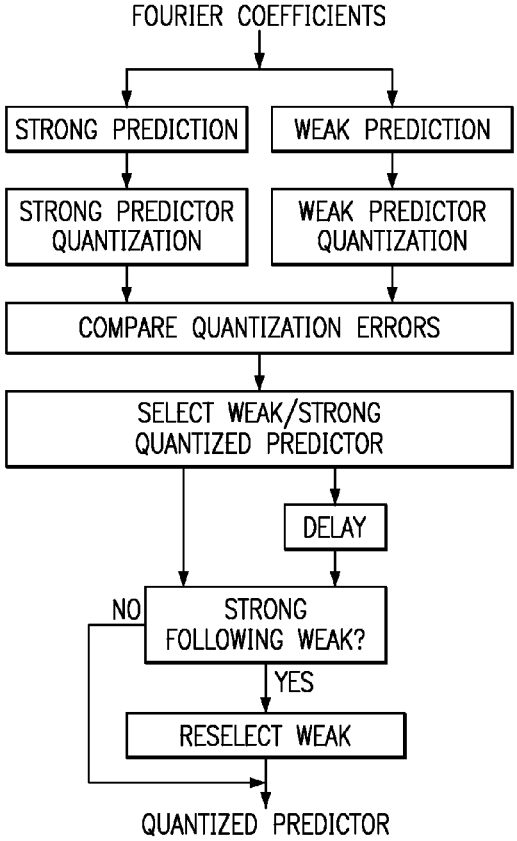

Second preferred embodiments allow for predictive coding of the spectra (or alternatively, other parameters such as line spectral frequencies or LSFs) and a selection of either the strong or weak predictor based on best approximation but with the proviso that a first strong predictor which otherwise follows a weak predictor is replaced with a weak predictor. This deters error propagation by a sequence of strong predictors of an error in a weak predictor preceding the series of strong predictors. FIG. 1*b* illustrates a predictive coding control flow.

MELP Model

Figure 2A:
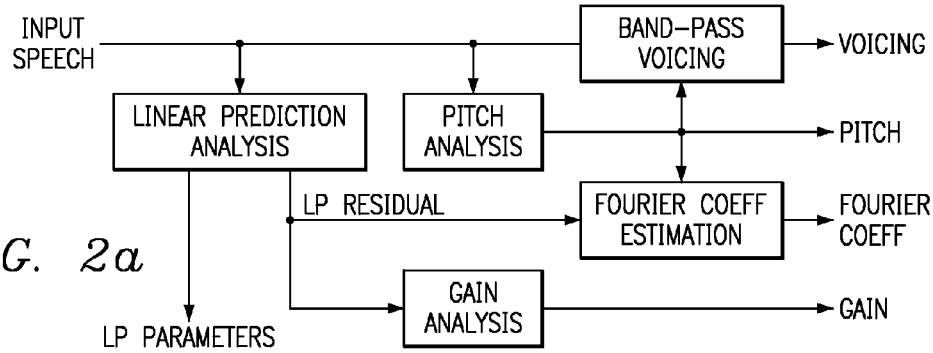
FIGS. 2*a*-2*b* illustrate preferred embodiment coder and decoder in block format.
Figure 2B:
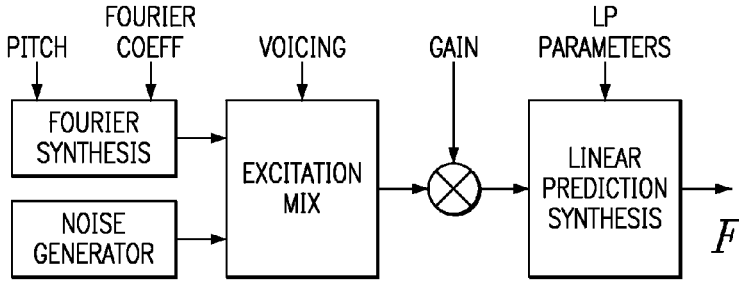

FIGS. 2*a*-2*b* illustrate preferred embodiment MELP coding (analysis) and decoding (synthesis) in block format. In particular, the Linear Prediction Analysis determines the LPC coefficients a(j), j=1, 2, . . . , M, for an input frame of digital speech samples {y(n)} by setting $$e(n)=y(n)-\Sigma_{M\geq j\geq 1}a(j)y(n-j) \tag{1}$$

and minimizing $\Sigma e(n)^2$. Typically, M, the order of the linear prediction filter, is taken to be about 10-12; the sampling rate to form the samples y(n) is taken to be 8000 Hz (the same as the public telephone network sampling for digital transmission); and the number of samples {y(n)} in a frame is often 160 (a 20 msec frame) or 180 (a 22.5 msec frame). A frame of samples may be generated by various windowing operations applied to the input speech samples. The name "linear prediction" arises from the interpretation of $e(n)=y(n)-\Sigma_{M\geq j\geq 1}a(j)y(n-j)$ as the error in predicting y(n) by the linear sum of preceding samples $\Sigma_{M\geq j\geq 1}a(j)y(n-j)$. Thus minimizing $\Sigma e(n)^2$ yields the {a(j)} which furnish the best linear prediction. The coefficients {a(j)} may be converted to LSFs for quantization and transmission.

The {e(n)} form the LP residual for the frame and ideally would be the excitation for the synthesis filter 1/A(z) where A(z) is the transfer function of equation (1). Of course, the LP residual is not available at the decoder; so the task of the encoder is to represent the LP residual so that the decoder can generate the LP excitation from the encoded parameters.

The Band-Pass Voicing for a frequency band of samples (typically two to five bands, such as 0-500 Hz, 500-1000 Hz, 1000-2000 Hz, 2000-3000 Hz, and 3000-4000 Hz) determines whether the LP excitation derived from the LP residual {e(n)} should be periodic (voiced) or white noise (unvoiced) for a particular band.

The Pitch Analysis determines the pitch period (smallest period in voiced frames) by low pass filtering {y(n)} and then correlating {y(n)} with {y(n+m)} for various m; interpolations provide for fractional sample intervals. The resultant pitch period is denoted pT where p is a real number, typically constrained to be in the range 20 to 132 and T is the sampling interval of ⅛ millisecond. Thus p is the number of samples in a pitch period. The LP residual {e(n)} in voiced bands should be a combination of pitch-frequency harmonics.

Fourier Coeff. Estimation provides coding of the LP residual for voiced bands. The following sections describe this in detail.

Gain Analysis sets the overall energy level for a frame.

The encoding (and decoding) may be implemented with a digital signal processor (DSP) such as the TMS320C30 manufactured by Texas Instruments which can be programmed to perform the analysis or synthesis essentially in real time.

Spectra of the Residual

Figure 3A:
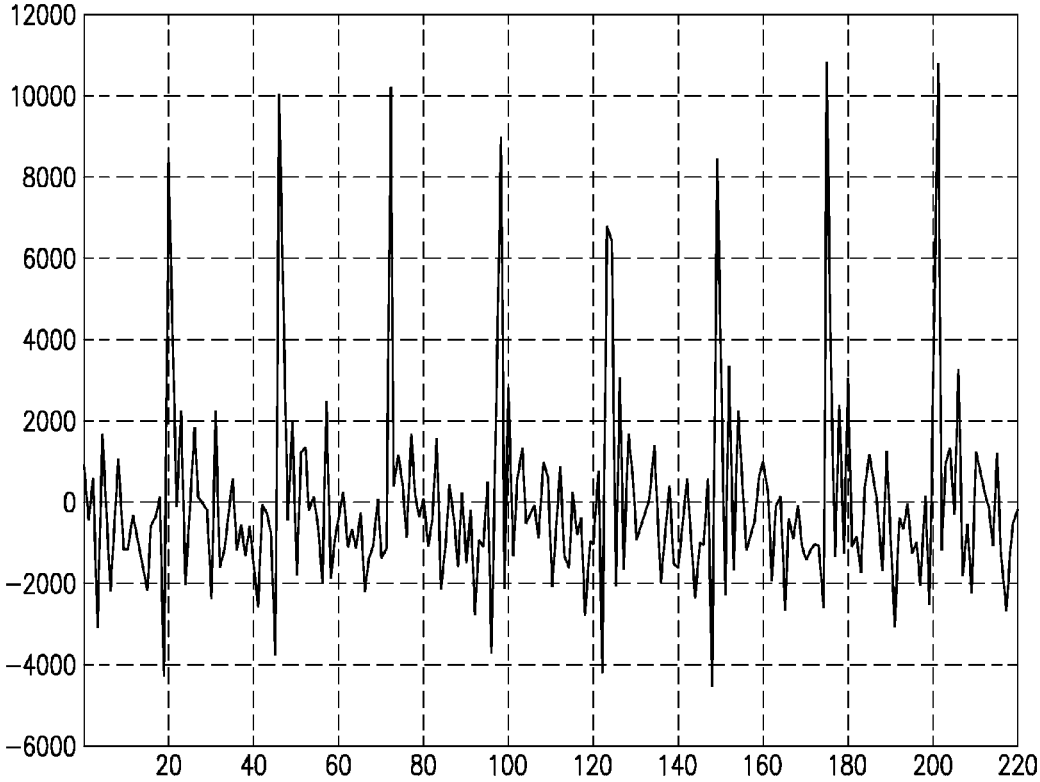
FIGS. 3*a*-3*d* show an LP residual and its Fourier transforms.
Figure 3B:
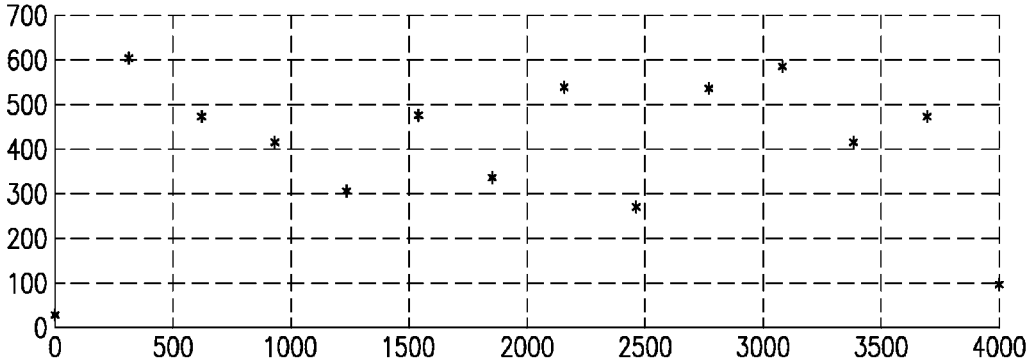
Figure 3C:
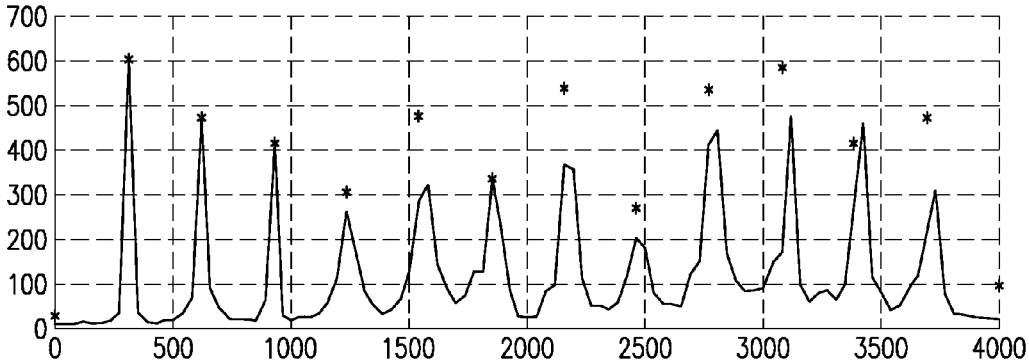

FIG. 3*a* illustrates an LP residual {e(n)} for a voiced frame and includes about eight pitch periods with each pitch period about 26 samples. FIG. 3*b* shows the magnitudes of the {E(j)} for one particular period of the LP residual, and FIG. 3*c* shows the magnitudes of the {E(j)} for all eight pitch periods. For a voiced frame with pitch period equal to pT, the Fourier coefficients peak about 1/pT, 2/pT, 3/pT, . . . , k/pT, . . . ; that is, at the fundamental frequency 1/pT and harmonics. Of course, p may not be an integer, and the magnitudes of the Fourier coefficients at the fundamental-frequency harmonics, denoted X[1], X[2], . . . , X[k], . . . must be estimated. These estimates will be quantized, transmitted, and used by the decoder to create the LP excitation.

Figure 3D:
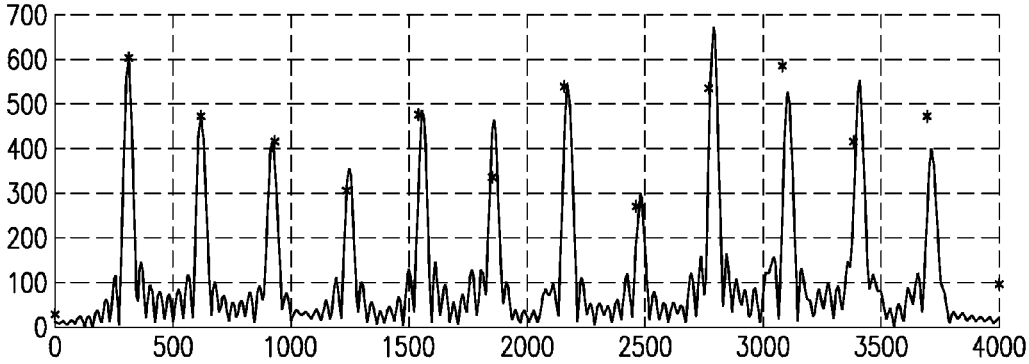

The {X[k]} may be estimated by various methods: for example, apply a discrete Fourier transform to the samples of a single period (or small number of periods) of e(n) as in FIGS. 3*b*-3*c*; alternatively, the {E(j)} can be interpolated. Indeed, one interpolation approach applies a 512-point discrete Fourier transform to an extended version of the LP residual, which allows use of a fast Fourier transform. In particular, extend the LP residual {e(n)} of 160 samples to 512 samples by setting $e_{512}(n)=e(n)$ for n=0, 1, . . . , 159, and $e_{512}(n)=0$ for n=160, 161, . . . , 511. Then the discrete Fourier transform magnitudes appear as in FIG. 3*d* with coefficients $E_{512}(j)$ which essentially interpolate the coefficients E(j) of FIGS. 3*b*-3*c*. Estimate the peaks X[k] at frequencies k/pT. The preferred embodiment only uses the magnitudes of the Fourier coefficients, although the phases could also be used. Because the LP residual components {e(n)} are real, the discrete Fourier transform coefficients {E(j)} are conjugate symmetric: E(k)=E*(N−k) for an N-point discrete Fourier transform. Thus only half of the {E(j)} need be used for magnitude considerations.

Codebooks for Fourier Coefficients

Once the estimated magnitudes of the Fourier coefficients X[k] for the fundamental pitch frequency and harmonics k/pT have been found, they must be transmitted with a minimal number of bits. The preferred embodiments use vector quantization of the spectra. That is, treat the set of Fourier coefficients X[1], X[2], . . . X[k], . . . as a vector in a multi-dimensional quantization, and transmit only the index of the output quantized vector. Note that there are [p] or [p]+1 coefficients, but only half of the components are significant due to their conjugate symmetry. Thus for a short pitch period such as pT=4 milliseconds (p=32), the fundamental frequency 1/pT (=250 Hz) is high and there are 32 harmonics, but only 16 would be significant (not counting the DC component). Similarly, for a long pitch period such as pT=12 milliseconds (p=96), the fundamental frequency (=83 Hz) is low and there are 48 significant harmonics.

In general, the set of output quantized vectors may be created by adaptive selection with a clustering method from a set of input training vectors. For example, a large number of randomly selected vectors (spectra) from various speakers can be used to form a codebook (or codebooks with multi-step vector quantization). Thus a quantized and coded version of an input spectrum X[1], X[2], . . . X[k], . . . can be transmitted as the index in the codebook of the quantized vector and which may be 20 bits.

As illustrated in FIG. 1*a*, the first preferred embodiments proceed with vector quantization of the Fourier coefficient spectra as follows. First, classify a Fourier coefficient spectrum (vector) according to the corresponding pitch period: if the pitch period is less than 55T, the vector is a "short" vector, and if the pitch period is more than 45T, the vector is a "long" vector. Some vectors will qualify as both short and long vectors. Vector quantize the short vectors with a codebook of 20-component vectors, and vector quantize the long vectors with a codebook of 45-component vectors. As described previously, conjugate symmetry of the Fourier coefficients implies only the first half of the vector components are significant and used. And for short vectors with less than 20 significant components, expand to 20 components by appending components equal to 1. Analogously for long vectors with fewer than 45 significant components, expand to 45 components by appending components equal to 1. Each codebook has $2^{20}$ output quantized vectors, so 20 bits will index the output quantized vectors in each codebook. One bit could be used to select the codebook, but the pitch is transmitted and can be used to determine whether the 20 bits are long or short vector quantization.

For a vector classified as both short and long, use the same classification as the preceding frame's vector; this avoids discontinuities and provides a hysteresis by the classification overlap. Further, if the preceding frame was unvoiced, then take the vector as short if the pitch period is less than 50T and long otherwise.

Apply a weighting factor to the metric defining distance between vectors. The distance is used both for the clustering of training vectors (which creates the codebook) and for the quantization of Fourier component vectors by minimum distance. In general, define a distance between vectors $X_1$ and $X_2$ by $d(X_1, X_2)=(X_1-X_2)^T W(X_1-X_2)$ with W a matrix of weights. Thus define matrices $W_{short}$ for short vectors and matrices $W_{long}$ for long vectors; further, the weights may depend upon the length of the vector to be quantized. Then for short vectors take $W_{short}[j,k]$ very small for either j or k larger than 20; this will render the components $X_1[k]$ and $X_2[k]$ irrelevant for k larger than 20. Further, take $W_{short}[j,k]$ decreasing as j and k increase from 1 to 20 to emphasize the lower vector components. That is, the quantization will depend primarily upon the Fourier coefficients for the fundamental and low harmonics of the pitch frequency. Analogously, take $W_{long}[j,k]$ very small for j or k larger than 45.

Further, the use of predictive coding could be included to reduce the magnitudes and decrease the quantization noise as described in the following.

Predictive Coding

A differential (predictive) approach will decrease the quantization noise. That is, rather than vector quantize a spectrum X[1], X[2], . . . X[k], . . . , first generate a prediction of the spectrum from the preceding one or more frames' quantized spectra (vectors) and just quantize the difference. If the current frame's vector can be well approximated from the prior frames' vectors, then a "strong" prediction can be used in which the difference between the current frame's vector and a strong predictor may be small.

Contrarily, if the current frame's vector cannot be well approximated from the prior frames' vectors, then a "weak" prediction (including no prediction) can be used in which the difference between the current frame's vector and a predictor may be large. For example, a simple prediction of the current frame's vector X could be the preceding frame's quantized vector Y, or more generally a multiple $\alpha Y$ with $\alpha$ a weight factor (between 0 and 1). Indeed, $\alpha$ could be a diagonal matrix with different factors for different vector components. For $\alpha$ values in the range 0.7-1.0, the predictor $\alpha Y$ is close to Y and if also close to X, the difference vector $X-\alpha Y$ to be quantized is small compared to X. This would be a strong predictor, and the decoder recovers an estimate for X by $Q(X-\alpha Y)+\alpha Y$ with the first term the quantized difference vector $X-\alpha Y$ and the second term from the previous frame and likely the dominant term. Conversely, for $\alpha$ values in the range 0.0-0.3, the predictor is weak in that the difference vector $X-\alpha Y$ to be quantized is likely comparable to X. In fact, $\alpha=0$ is no prediction at all and the vector to be quantized is X itself.

The advantage of strong predictors follows from the fact that with the same size codebooks, quantizing something likely to be small (strong-predictor difference) will give better average results than quantizing something likely to be large (weak-predictor difference).

Thus train four codebooks: (1) short vectors and strong prediction, (2) short vectors and weak prediction, (3) long vectors and strong prediction, and (4) long vectors and weak prediction. Then process a vector as illustrated in the top portion of FIG. 1*b*: first the vector X is classified as short or long; next, the strong and weak predictor vectors, $X_{strong}$ and $X_{weak}$, are generated from previous frames' quantized vectors and the strong predictor and weak predictor codebooks are used for vector quantization of $X-X_{strong}$ and $X-X_{weak}$, respectively. Then the two results $(Q(X-X_{strong})+X_{strong}$ and $Q(X-X_{weak})+X_{weak})$ are compared to the input vector and the better approximation (strong or weak predictor) is selected. A bit is transmitted (to indicate whether a strong or weak predictor was used) along with the 20-bit codebook index for the quantization vector. The pitch determines whether the vector was long or short.

Prediction Control

In a frame erasure the parameters (i.e., LSFs, Fourier coefficients, pitch, . . . ) corresponding to the current frame are considered lost or unreliable and the frame is reconstructed based on the parameters from the previous frames. In the presence of frame erasures the error resulting from missing a set of parameters will propagate throughout the series of frames for which a strong prediction is used. If the error occurs in the middle of the series, the exact evolution of the predicted parameters is compromised and some perceptual distortion is usually introduced. When a frame erasure happens within a region where a weak predictor is consistently selected, the effect of the error will be localized (it will be quickly reduced by the weak prediction). The largest degradation in the reconstructed frame is observed whenever a frame erasure occurs for a frame with a weak predictor followed by a series of frames for which a strong predictor is chosen. In this case the evolution of the parameters is builtup on a parameter very different from that which is supposed to start the evolution.

Thus a second preferred embodiment analyzes the predictors used in a series of frames and controls their sequencing. In particular, for a current frame which otherwise would use a strong predictor immediately following a frame which used a weak predictor, one preferred embodiment modifies the current frame to use the weak predictor but does not affect the next frame's predictor. FIG. 1*b* illustrates the decisions.

A simple example will illustrate the effect of this preferred embodiment. Presume a sequence of frames with Fourier coefficient vectors $X_1$, $X_2$, $X_3$, . . . and presume the first frame uses a weak predictor and the second, third, fourth, . . . frames use strong predictors, but the preferred embodiment replaces the second frame's strong predictor with a weak predictor. Thus the transmitted quantized difference vector for the first frame is $Q(X_1-X_{1weak})$ and without erasure the decoder recovers $X_1$ as $Q(X_1-X_{1weak})+X_{1weak}$ with the first term likely the dominant term due to weak prediction. Similarly, the usual decoder recovers $X_2$ as $Q(X_2-X_{2strong})+X_{2strong}$ with the second term dominant, and analogously for $X_3$, $X_4$, . . . In contrast, the preferred embodiment decoder recovers $X_2$ as $Q(X_2-X_{2weak})+X_{2weak}$ but with the first term likely dominant.

Note that the decoder recreates $X_{1weak}$ from the preceding reconstructed frames' vectors $X_0$, $X_{-1}$, . . . , and similarly for $X_{2strong}$ and $X_{2weak}$ recreated from reconstructed $X_1$, $X_0$, . . . , and likewise for the other predictors.

Now with an erasure of the first frame parameters the vector $Q(X_1-X_{1weak})$ is lost and the decoder reconstructs the $X_1$ by something such as just repeating reconstructed $X_0$ from the prior frame. However, this may not be a very good approximation because originally a weak predictor was used. Then for the second frame, the usual decoder reconstructs $X_2$ by $Q(X_2-X_{2strong})+Y_{2strong}$ with $Y_{2strong}$ the strong predictor recreated from $X_0$, $X_0$, . . . rather than from $X_1$, $X_0$, . . . because $X_1$ was lost and replaced by possibly poor approximation $X_0$. Thus the error would roughly be $X_{2strong}-Y_{2strong}$ which likely is large due to the strong predictor being the dominant term compared to the difference term $Q(X_2-X_{2strong})$. And this also applies to the reconstruction of $X_3$, $X_4$, . . .

Contrarily, the preferred embodiment reconstructs $X_2$ by $Q(X_2-X_{2weak})+Y_{2weak}$ with $Y_{2strong}$ the weak predictor recreated from $X_0$, $X_0$, . . . rather than from $X_1$, $X_0$, . . . again because $X_1$ was lost and replaced by possibly poor approximation $X_0$. Thus the error would roughly be $X_{2weak}-Y_{2weak}$ which likely is small due to the weak predictor being the smaller term compared to the difference term $Q(X_2-X_{2weak})$. And this smaller error also applies to the reconstruction of $X_3$, $X_4$, Indeed for the case of the predictors $X_{2strong}=\alpha X_1$ with $\alpha=0.8$ and $X_{2weak}=\alpha X_1$ with $\alpha=0.2$, the usual decoder error would be $0.8(X_1-X_0)$ for reconstruction of $X_2$ and the preferred embodiment decoder error would be $0.2(X_1-X_0)$.

Alternative Prediction Control

Alternative second preferred embodiments modify two (or more) successive frame's strong predictors after a weak predictor frame to be weak predictors. That is, a sequence of weak, strong, strong, strong, . . . would be changed to weak, weak, weak, strong, . . .

The foregoing replacement of strong predictors by weak predictors provides a tradeoff of increased error robustness for slightly decreased quality (the weak predictors being used in place of better strong predictors).

What is claimed is:

1. An encoding method for digital speech using strong and weak predictors for spectra vectors, comprising the steps of:

(a) replacing a strong predictor for a current frame following a preceding frame using a weak predictor with a weak predictor for said current frame; and (b) outputting the weak predictor for said current frame as the predictor for said current frame.

2. The method of claim 1, wherein:

(a) said strong predictor and said weak predictor predict the Fourier coefficients for the pitch harmonics.

3. The method of claim 2, wherein:

(a) said strong predictor equals a multiple of the Fourier coefficients of a prior frame with the multiple in the range of 0.7 to 1.0; and (b) said weak predictor equals a second multiple of the Fourier coefficients of said prior frame with said second multiple in the range of 0.0 to 0.3.

4. The method of claim 1, wherein:

(a) said step (a) of claim 1 replaces a second successive strong predictor with a corresponding second weak predictor.

* * * * *